US009818291B2

(12) United States Patent
Hua et al.

(10) Patent No.: US 9,818,291 B2
(45) Date of Patent: Nov. 14, 2017

(54) SYSTEM ARM NOTIFICATION BASED ON BLE POSITION

(71) Applicant: Honeywell International Inc., Morristown, NJ (US)

(72) Inventors: WeiFeng Hua, Shanghai (CN); George Li, Shanghai (CN); Ziv Wang, Shanghai (CN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/851,109

(22) Filed: Sep. 11, 2015

(65) Prior Publication Data

US 2017/0076583 A1 Mar. 16, 2017

(51) Int. Cl.

| | |
|---|---|
| ***G08B 1/08*** | (2006.01) |
| ***G08B 25/00*** | (2006.01) |
| ***G08B 25/14*** | (2006.01) |
| ***G08B 25/01*** | (2006.01) |
| ***G08B 25/10*** | (2006.01) |

(52) U.S. Cl.

CPC ..... *G08B 25/008* (2013.01); *G08B 25/016* (2013.01); *G08B 25/10* (2013.01); *G08B 25/14* (2013.01); *G08B 25/003* (2013.01)

(58) Field of Classification Search

CPC ..... G08B 25/14; G08B 13/00; G08B 29/185; G08B 21/00; H04W 4/02

USPC ..... 340/539.1

See application file for complete search history.

(56) References Cited

U.S. PATENT DOCUMENTS

2014/0282048 A1 9/2014 Shapiro et al.
2014/0313032 A1* 10/2014 Sager ..... H04Q 9/00 340/539.17
2016/0043905 A1* 2/2016 Fiedler ..... G06F 3/0482 715/736
2016/0049071 A1* 2/2016 Beaver ..... G08B 29/185 340/514
2016/0078698 A1* 3/2016 Moses ..... G08B 25/14 340/5.23
2016/0189496 A1* 6/2016 Modi ..... G08B 13/08 340/545.2

FOREIGN PATENT DOCUMENTS

EP 1713044 A2 10/2006

OTHER PUBLICATIONS

Extended European search report from corresponding EP patent application 16187571.1, dated Apr. 19, 2017.

* cited by examiner

*Primary Examiner* — Tai T Nguyen
(74) *Attorney, Agent, or Firm* — Huschblackwell LLP

(57) ABSTRACT

A system is provided that includes a control panel of a security system that detects threats within a secured geographic area, a least one Bluetooth low energy (BLE) device located within the secured area that transmits a wireless location identification signal, a portable wireless device of the security system that detects the wireless location identification signal, and a processor of the security system that displays a screen used to arm the security system in response to the wireless location identification signal detected by the portable wireless device.

13 Claims, 1 Drawing Sheet

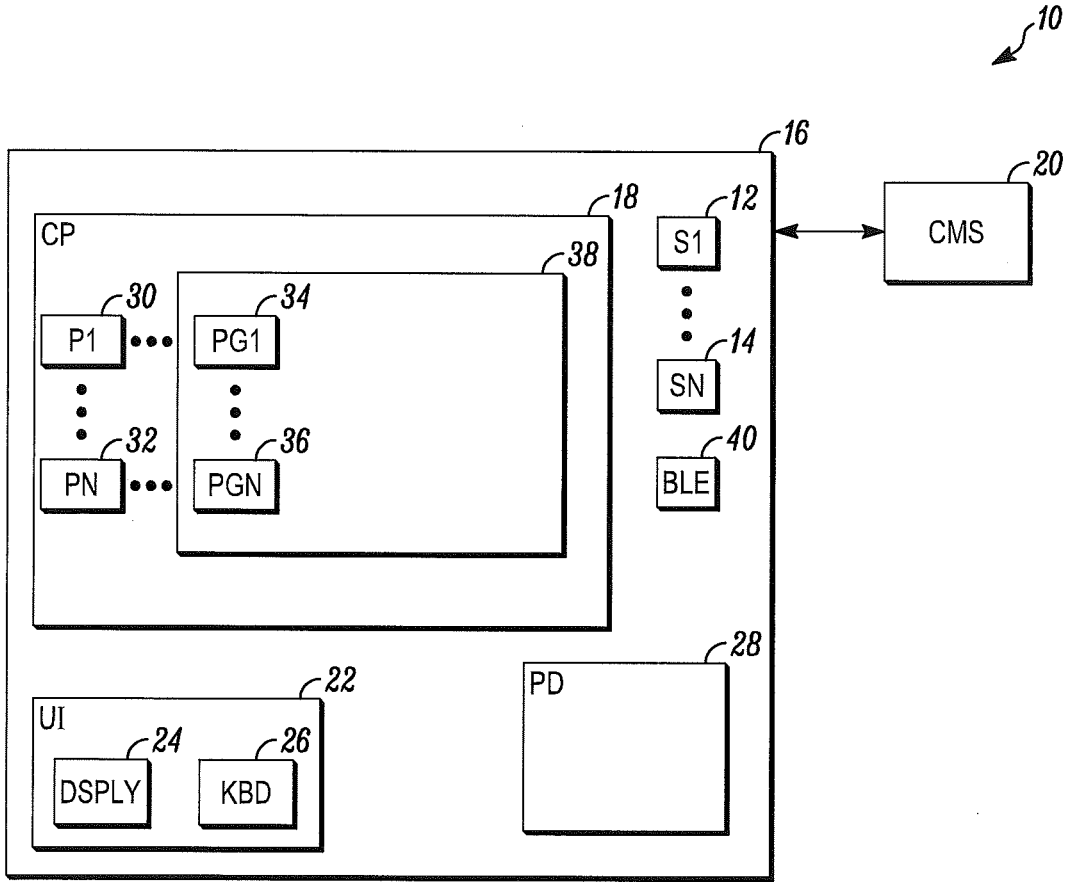
10
16
20
CMS
18
12
S1
CP
38
30
34
P1
PG1
14
SN
32
36
40
PN
PGN
BLE
28
22
PD
UI
24
26
DSPLY
KBD

SYSTEM ARM NOTIFICATION BASED ON BLE POSITION

FIELD

This application relates to security systems and, more particularly, to the arming of such systems.

BACKGROUND

Systems are known to protect people and assets within secured areas. Such systems are typically based upon the use of one more sensors that detect threats within the areas.

Threats to people and assets may originate from any of a number of different sources. For example, a fire may kill or injure occupants who have become trapped by a fire in a home. Similarly, carbon monoxide from a fire may kill people in their sleep.

Alternatively, an unauthorized intruder, such as a burglar, may present a threat to assets within an area. Intruders have also been known to injure or kill people living within the area.

In the case of intruders, sensors may be placed in different areas based upon the respective uses of those areas. For example, if people are present during some portions of a normal day and not at other times, then sensors may be placed along a periphery of a space to provide protection while the space is occupied while additional sensors may be placed within an interior of the space and used when the space is not occupied.

In most cases, threat sensors are connected to a local control panel. In the event of a threat detected via one of the sensors, the control panel may sound a local audible alarm. The control panel may also send a signal to a central monitoring station.

While conventional security systems work well, it is sometimes difficult or inconvenient to remember to arm a system before exiting an area. Accordingly, a need exists for better methods and an apparatus for reminding a user to arm a security system before exiting.

BRIEF DESCRIPTION OF THE DRAWINGS

FIG. 1 illustrates a block diagram of a security system in accordance herewith.

DETAILED DESCRIPTION

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

FIG. 1 is a block diagram of a security system 10 shown generally in accordance with an illustrated embodiment. Included within the system are a number of sensors 12, 14 that detect threats to people and assets within a secured geographic area 16. The sensors may be embodied in any of a number of different forms depending on the threat to be detected. For example, at least some of the sensors may be environmental sensors (e.g., smoke sensors, carbon monoxide detectors, etc.) provided for the detection of fires.

Other ones of the sensors may be intrusion sensors. For example, some of the sensors may be switches placed on doors and/or windows providing entrance into and egress from the secured area. Others may be passive infrared (PIR) detectors placed somewhere in the interior of the secured area in order to detect intruders who have been able to circumvent sensors located along the periphery of the secured area. Still other of the sensors may include closed-circuit television (CCTV) camera with motion detection capabilities.

The sensors may be monitored via a control panel 18 located within the secured area, as shown in FIG. 1, or located remotely. Upon activation of one of the sensors, an alarm message may be sent to a central monitoring station 20. The central monitoring station may respond by summoning the appropriate help (e.g., police, fire department, etc.).

The security system may be controlled by an authorized user through a user interface 22. For example, the user may enter a personal identifier (PIN) and activate a function key or simply activate a function key on a keyboard 26 to arm the system. Similarly, the user may enter his/her PIN and a disarm key to disarm the system. Upon entry of each instruction, the status of the system may be shown on a display 24.

The security system may also include a wireless portable device (e.g., a smartphone, tablet, etc.) for control of the system. The portable device may have features that emulate the functionality of the user interface.

Included within the control panel, the sensors, the user interface, and the portable device may be circuitry that accomplishes the functionality described below. The circuitry may include one or more processor apparatus (processors) 30, 32 each operating under control of one or more computer programs 34, 36 loaded from a non-transitory computer readable medium (memory) 38. As used herein, reference to a step performed by a computer program is also reference to the processor that executed that step.

For example, a status processor of the control panel having a number of different states (e.g., armed away, armed stay, disarmed, etc.) may monitor the user interface and portable device for instructions. Upon receiving a PIN of the authorized user, the status processor may compare the PIN with a list of authorized users in memory. If the entered PIN matches an entry within the list of authorized users, the status processor assumes the state requested by a function command.

Similarly, an alarm processor may monitor the sensors based upon the alarm state. In the armed away state, the alarm processor may monitor all of the sensors. In the armed stay state, the alarm processor may only monitor the sensors along the periphery of the secured area. Upon activation of one of the sensors, the alarm processor may compose an alarm message and send it to the central monitoring station. The alarm message may include a system identifier (e.g., an account number, an address, etc.), an identifier of the activated sensor, a function identifier of the activated sensor (e.g., fire, intrusion, etc.), and a time.

Under one illustrated embodiment, the security system has the ability to sense the impending departure of the authorized user from the secured area and to present the appropriate screen on a display of the system. For example, in preparation for departure, the user would want to be able to easily select the appropriate security function (e.g., armed away). Accordingly, upon detecting the impending departure of the user, the system displays an arm screen on the display. Under one embodiment, the display is on the user interface. Under another embodiment, the arm screen is displayed on the portable device. Under still another embodiment, the arm screen is simultaneously presented on both the user interface and portable device.

In general, the detection of the location of the authorized user is accomplished via a Bluetooth low energy (BLE) device 40. The BLE device may operate under a number of different formats (e.g., iBeacon, other corresponding BLE technology for Android systems, etc.). The BLE device may be located near a door providing an exit from the secured area. The BLE device may be embedded in a door frame or wall adjacent the door or may simply be attached by an adhesive to the door or wall.

In this regard, a monitoring processor within the portable device may operate in the background to continuously monitor for the presence of the BLE device. For example, BLE devices are of a relatively short range. Accordingly, the monitoring processor would not detect the BLE device until the user were proximate the door as the user exits the secured area.

Operating in conjunction with the monitoring processor may be a number of auxiliary processors that display the arming screen of the security system. For example, a communication processor may establish a wireless connection with the control panel and send notification of detection of the BLE device to the control panel. Upon receipt of the notification, a status change processor may present an arming screen on the user interface of the control panel. The user may then activate an arm away key displayed on the screen to arm the system.

Alternatively or simultaneously, another processor of the portable device may respond to detection of the BLE device by activating a security system interface operating on the portable device. In response, the processor may display an arm away screen on the portable device. The user may then activate an arm away key displayed on the screen of the portable device to arm the system.

The use of the BLE device to display the appropriate screens of the security system operates save time by presenting the correct screen for arming the system as the user approaches an exit. Alternatively, the BLE device operates to remind and prompt the user to arm the system before the user leaves the secured area.

In most cases, when a user leaves his/her home, he/she wants to arm his/her security system. So if the system can detect such conditions, the panel switches to an arm menu in anticipation of departure, and the user can simply press the appropriate button on the panel before he/she leaves. This is convenient for the user.

BLE devices have a very limited range. Because the indoor positioning technology of BLE devices is of sufficient accuracy to detect some special movement of people via their mobile phones (e.g., the user preparing to leave or even when he/she crosses the threshold of the exit door), the BLE devices may be used to remind the user of the need to arm his/her security system.

As the user approaches an exit door, the BLE device sends broadcast frames periodically (e.g., as iBeacon for Apple device). A mobile phone application uses these signals to determine its indoor position. If the mobile phone application detects that the user wants to leave the home, it sends such information to the alarm system so the alarm system can cause its panel to switch to an arm menu or asks the user to use his mobile phone to arm the system.

In general, the system includes a control panel of a security system that detects threats within a secured geographic area, a least one Bluetooth low energy (BLE) device located within the secured area that transmits a wireless location identification signal, a portable wireless device that detects the wireless location identification signal, and a processor that displays a screen used to arm the security system on a display in response to the detected wireless location identification signal.

Alternatively, the system includes a security system that detects threats within a secured geographic area, a least one Bluetooth low energy (BLE) device located proximate an exit of the secured area wirelessly coupled to the security system, a portable wireless device that detects the BLE device, and a processor that displays a screen that arms the security system on a display in response to the detected BLE device.

Alternatively, the system includes a sensor that detects threats within a secured geographic area, a control panel that monitors the sensor, a least one Bluetooth low energy (BLE) device located proximate an exit of the secured area wirelessly coupled to the security system, a portable wireless device that detects the BLE device, and a processor that displays a screen that arms the security system on a display in response to the detected BLE device.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. An apparatus comprising:

a control panel of a security system that detects threats within a secured geographic area;

at least one Bluetooth low energy device located near a door providing an exit from the secured geographic area that autonomously transmits a wireless location identification signal; and a portable wireless device that detects the wireless location identification signal, wherein the portable wireless device sends a notification of the wireless location identification signal to the control panel of the security system and, responsive thereto, the control panel initiates a display of an arm screen including an arm activation key used to arm the security system.

2. The system as in claim 1 wherein the Bluetooth low energy device is supported by a front door jam or wall adjacent to the exit of the secured geographic area.

3. The system as in claim 1 wherein the arm screen is displayed on a display of the portable wireless device.

4. The system as in claim 3 wherein the portable wireless device receives an input selecting the arm activation key and sends an arm command to the security system.

5. The system as in claim 1 wherein the portable wireless device forms a wireless connection with the control panel of the security system.

6. The system as in claim 1 wherein the arm screen is displayed on a display panel of the security system.

7. An apparatus comprising:

a security system that detects threats within a secured geographic area;

a least one Bluetooth low energy device located proximate an exit of the secured geographic area;

a portable wireless device that detects a wireless signal autonomously transmitted from the Bluetooth low energy device and sends a notification of the wireless signal to the security system; and a processor of the security system that initiates, responsive to the notification, a display of an arm screen including an arm activation key for arming the security system.

8. The apparatus as in claim 7 further comprising a control panel of the security system that displays the arm screen on a display.

9. The system as in claim 7 wherein the arm screen is displayed on a user interface of the portable wireless device.

10. The system as in claim 9 wherein the portable wireless device receives an input selecting the arm activation key and sends an arm command to the security system.

11. The system as in claim 10 wherein the processor of the security system accepts the arm command and changes a status of the security system to armed.

12. An apparatus comprising:

a sensor that detects threats within a secured geographic area;

a control panel that monitors the sensor;

a least one Bluetooth low energy device located proximate an exit of the secured geographic area, the Bluetooth low energy device autonomously and wirelessly transmitting an identification signal;

a portable wireless device that detects the identification signal and sends a wireless notification of the identification signal to the control panel; and a processor of the control panel that initiates display of an arm screen including an arm activation key used to arm the security system.

13. The apparatus as in claim 12 further comprising a display located on one of the control panel and the portable wireless device that displays the arm screen.

* * * * *